United States Patent [19]

Shepard

[11] 4,322,051

[45] Mar. 30, 1982

[54] SHELF BRACKET ASSEMBLY

[76] Inventor: John S. Shepard, 1304 S. Shields St., Ft. Collins, Colo. 80521

[21] Appl. No.: 172,827

[22] Filed: Jul. 28, 1980

Related U.S. Application Data

[62] Division of Ser. No. 72,351, Sep. 4, 1979, Pat. No. 4,231,300.

[51] Int. Cl.[3] ..... A47B 47/00

[52] U.S. Cl. ..... 248/235; 108/60; 108/107; 211/153; 248/250

[58] Field of Search ..... 108/108, 111, 107, 60; 52/36, 73, 78, 283, 656; 211/187, 153, 184, 11; 248/250, 243, 248, 235, 556; 217/7, 10

[56] References Cited

U.S. PATENT DOCUMENTS

| | | | |
|---|---|---|---|
| 654,402 | 7/1900 | King | 248/551 |
| 1,915,727 | 6/1933 | Friedemann | 248/250 X |
| 1,980,854 | 11/1934 | Eberle | 248/242 X |
| 2,653,783 | 9/1953 | Lindsay | 248/243 |
| 3,370,388 | 2/1968 | Dielman | 52/73 X |
| 3,648,419 | 3/1972 | Marks | 211/153 X |
| 4,053,132 | 10/1977 | Del Pozzo | 248/235 |

FOREIGN PATENT DOCUMENTS

| | | | |
|---|---|---|---|
| 848852 | 9/1952 | Fed. Rep. of Germany | 248/235 |
| 864445 | 6/1953 | Fed. Rep. of Germany | 211/184 |
| 1316608 | 12/1962 | France | 248/235 |
| 389197 | 6/1965 | Switzerland | 248/235 |

*Primary Examiner*—James T. McCall
*Attorney, Agent, or Firm*—Hugh H. Drake

[57] ABSTRACT

The assembly includes a shelf bracket for constructing shelving from spaced elongated shelf boards that have a standard thickness. An elongated leg of rectangular cross section includes a longitudinal groove formed into one of its major surfaces. A pair of U-shaped clips each are in the form of a pair of plates joined by a flat bight with the widths of the plates being spaced apart for snug engagement with a marginal edge portion of a shelf board. The bight seats tightly in the groove and preferably has a thickness substantially equal to the depth of the groove. The clips are individually secured in respective different spaced portions of the groove with the bight seated therein.

1 Claim, 3 Drawing Figures

SHELF BRACKET ASSEMBLY

RELATED APPLICATION

This application is a division of co-pending application Ser. No. 072,351, filed Sept. 4, 1979, now Patent No. 4,231,300 by the same inventor.

The present invention pertains to a shelf bracket. More particularly, it relates to simplified but yet quite attractive brackets.

In my co-pending application Ser. No. 913,202, filed June 6, 1978, now U.S. Pat. No. 4,183,488, issued Jan. 15, 1980, a one-piece bracket is disclosed. It includes elongated legs at either end of which are integrally formed clips each of which is shaped to grip the marginal edge portion of a shelf board. Being preferably molded from plastic, the brackets are inexpensive and lightweight. With four of such brackets, one for each corner, a pair of shelf boards can be supported one above another so as to form a simple two-tier bookshelf. By arranging further pairs of the brackets in various combinations, additional shelf boards may be stacked in any of a variety of different arrangements. Moreover, the brackets may be easily removed later for the purpose of moving or storing the shelf materials.

Being pre-molded as a single unit, the brackets of the aforesaid application impose the restriction that shelf spacing is restricted to the spacing between the integrally-formed clips. To provide a different bracket length, a separate mold at least normally is required. Unless those brackets, and particularly the arms of the clips, are made to be comparatively thick, the weight which may be carried upon the supported shelving must be limited in order to avoid fracture of the brackets. Moreover, such brackets are rather neutral in appearance, so that they do not provide much in the way of decoration.

It is, accordingly, a general object of the present invention to provide a new and improved shelf bracket which permits following the general approach of the brackets in the aforementioned application while yet avoiding the disadvantages of those brackets.

Another object of the present invention is to provide a new and improved shelf bracket assembly which features substantial ruggedness.

A shelf bracket, for constructing an assembly of shelving from spaced elongated shelf boards of standard thickness, has a generally U-shaped clip with a pair of plates joined by a flat bight and with those plates being parallel-spaced apart a distance substantially equal to the standard thickness for snug engagement with a marginal edge portion of a shelf board. An aperture through one of the plates receives a fastener that secures that plate to the marginal edge portion of a shelf board. A pair of laterally-spaced apertures extend through the bight and are receptive of a fastener that secures the clip into a fixed location. A first stub integrally projects outwardly from the exterior of one of the plates and is in alignment with the bite. A second stub integrally projects outwardly from the exterior of the other of the plates and also is in alignment with the bight. Defined at each entrance of the respective ones of the fasteners into the corresponding ones of the apertures are means for enabling the fasteners effectively to seat flush and unobtrusively within the openings.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
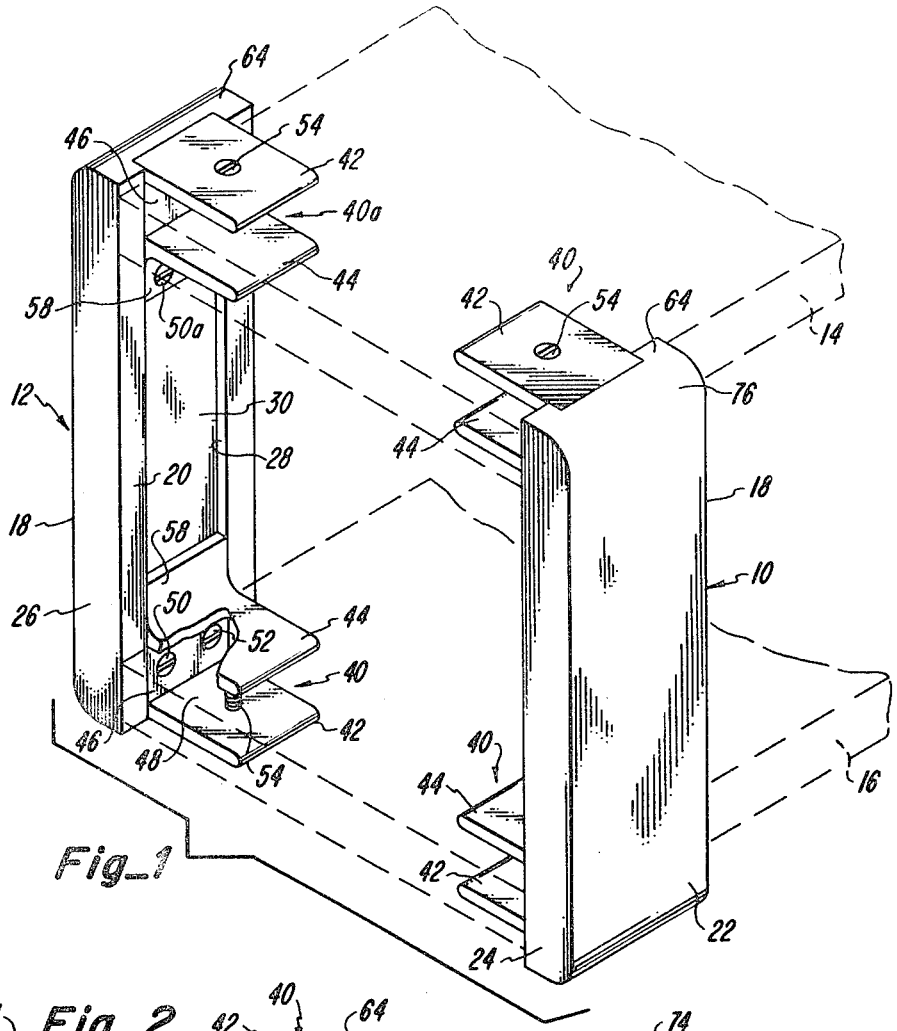
FIG. 1 is an isometric view of a pair of facing shelf brackets arranged to support a vertically stacked pair of shelf boards fragmentary end portions of which are shown in phantom, a portion of one component being broken away.

A pair of shelf bracket assemblies 10 and 12 serve for constructing shelving from vertically-spaced elongated shelf boards 14 and 16. Each of boards 14 and 16 is of a thickness as standardized in the lumber supply industry, three-fourths inch being typical for the kind of bookshelves often found in residential and office space.

Each bracket assembly includes an elongated leg 18 of generally rectangular lateral cross section, so as to have space-opposed major surfaces 20 and 22 joined by space-opposed minor surfaces 24 and 26. A longitudinal groove 28, having a bottom 30, is cut or otherwise formed into major surface 20. Groove 28 is selected to have a carefully-determined and uniform width and depth.

A preferred form of a U-shaped clip 40 is disposed at the lower end of leg 18 in bracket assembly 12. Clip 40 includes a pair of plates 42 and 44 joined by a bight 46. Plates 42 and 44 are spaced apart a distance substantially equal to the standard thickness of board 16, so as to achieve snug engagement with the marginal edge portion 48 of that board. Bight 46 has a width which cannot be greater than and is selected as closely as possible to be substantially the same as the width of groove 28. Moreover, bight 46 has a thickness which desirably is no greater than the depth of groove 28 and preferably is substantially equal to that depth, so as to be flush with the remainder of surface 20.

A pair of laterally spaced apertures are formed through bight 46 to receive fasteners in the form of screws 50 and 52 for securing bight 46, and hence clip 40, onto bottom 30 of groove 28. In many cases, only one screw fastener through bight 46 and into leg 18 will be sufficient. However, both of screws 50 and 52 are preferred for the purpose of affording additional rigidity and stability of clip 40 relative to leg 18. Formed through one of plates 42 and 44, in this case preferably through plate 42, is another aperture through which a further fastener in the form of a screw 54 is secured into marginal edge portion 48 of board 16.

If desired, a plurality of openings may be pre-drilled or otherwise formed along one side of each marginal portion 48 of each of boards 14 and 16. Those openings are spaced and located to align with respective ones of the apertures through which screws 54 are inserted. Each such opening has a diameter which approximates the maximum root diameter of the threads on screws 54, so that those threads tap themselves into engagement with the boards as the screws are turned.

For many purposes, formation of clip 40 to have only the components thus far described will be sufficient to seat the flat bottom of bight 46 securely against bottom 30 of groove 28 and result in a useful assembly. For still further stability, however, it is preferred that clip 40 include a stub 58 that integrally projects outwardly from the exterior of plate 42 and in alignment with bight 46. Stub 58 also has a width no greater than and preferably substantially the same as the width of groove 28 as well as a thickness no greater than and preferably the same as the depth of that groove. Thus, stub 58 also seats on bottom 30 of groove 28 when assembled.

Ordinarily, all of the clips used in connection with legs 18 would be identical. Clip 40 as already described has the preferable feature that the heads of screws 50 and 52 are concealed by board 16 when the bookcase has been assembled. All apertures preferably are counter-beveled on their side which seats the screw head, so that using a conventional flat head screw results in the exterior of the screw head being flush with the surface of the material through which it is received. With the preferred thickness of bight 46 being the same as the depth of groove 28, it will be observed that, upon assembly, the outer edge surface of board 16 rests flush against both the interior surface of bight 46 and the remaining portions of major surface 20 on leg 18. The same thing preferably is true at all other corners. This contributes not only to neatness and the avoidance of a dust-catching crevice but also to the stability of the resulting overall bookcase.

While, as indicated, all of the clips in a given assembly will usually be identical, a modified clip **40*a* is shown in FIG. 1 at the upper end of leg 18 of assembly 12. In this case, a clip-mounting aperture, receptive of a screw 50*a*, is defined through stub 58 in lieu of the formation of any apertures through bight 46. As before, a single aperture through stub 58 often is sufficient, but the preferred arrangement also includes a second aperture (not shown) through stub 58 in this version. One of the advantages in the form of clip 40*a* is that the head of screw 50*a* is more exposed, and that tends to make it easier to get the screw started into bottom 30 of groove 28**.

Figure 2:
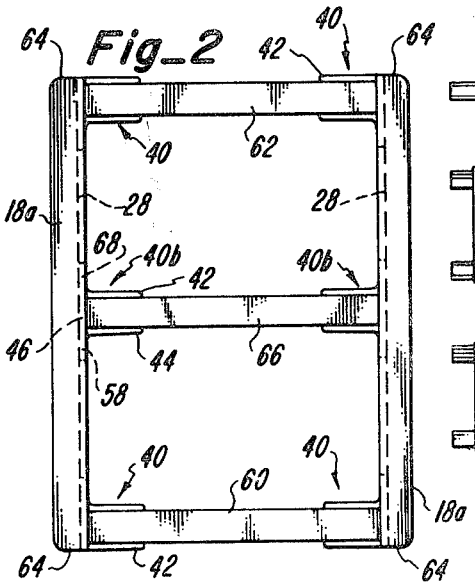
FIG. 2 is an end elevational view of a shelf assembly constructed by use of brackets generally like those shown in FIG. 1 but including additional components.

FIG. 2 illustrates a bookshelf having longer legs **18*a* with clips 40 at the respective top and bottom ends thereof so as to support shelves 60 and 62. Like in FIG. 1, each of clips 40 is disposed so that the exterior surface of its outer plate 42 is aligned to be flush with the end surface 64 at that end of the associated one of legs 18*a* (as at end portions 64 of legs 18 in FIG. 1**). The result is a neat, finished appearance at each end of the legs.

The bookshelf of FIG. 2 also includes an intermediate shelf board 66 secured between clips **40*b* disposed in groove 28 centrally of the length of legs 18*a*. Each of clips 40*b* include top and bottom plates 42 and 44 joined by a bight 46. In addition to a stub 58 projecting outwardly at the bottom of the clip, another flat stub 68 integrally projects outward from the exterior of the other plate 42 and again in alignment with bight 46. Stub 68 also preferably has the same width and thickness as the width and depth of groove 28**.

Thus, clip **40*b* represents still another version which may, if desired, be substituted for any of the other clips shown in FIGS. 1 or 2. In this case, the apertures for securing a clip 40*b* as seated in groove 28 may be formed in either or both of stubs 58 and 68 or through bight 46. Of course, with apertures formed at least in both stubs 58 and 68, and considering the still greater length of the total flat surface on the bottom of the clip which seats on bottom 30 of groove 28, it will be observed that clip 40*b*** is the version which affords the greatest rigidity of connection and stability with respect to the associated leg.

Just with the three different clip versions specifically illustrated, a number of alternatives of assembly are possible. For example, it may in some cases be desirable to invert clip 40 and dispose it with the outer end of stub 58 oriented flush with end surface 64 of leg 18. With that mode of orientation at the top of the leg, the upper end portion of that leg will, of course, project above the associated shelf board. At the same time, the end of groove 28 will be filled by stub 58 for neatness of appearance. The same projection of the end portion of the leg also could occur at the bottom thereof by inverting the clips from the orientation illustrated. That would serve to raise the bottom shelf board above the level of the floor or other surface upon which the bookcase sits. On the other hand, the manner of assembly illustrated in FIGS. 1 and 2 often is preferred, because lower plates 42 then serve as additional foot area for the assembled bookcase, thereby increasing overall stability. Of course, the clips may be disposed at any place along the length of the grooves as desired.

Figure 3:
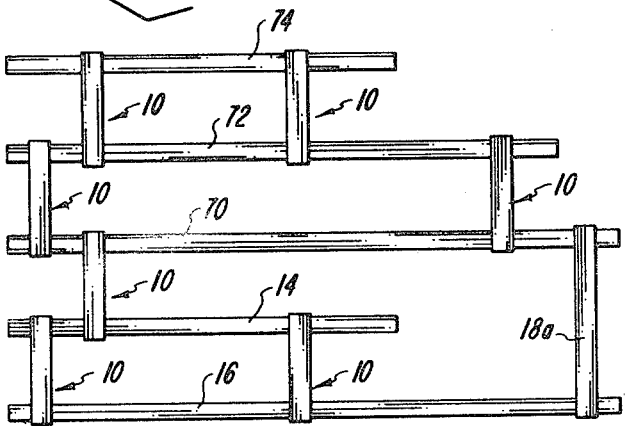
FIG. 3 is a somewhat diagrammatic front elevational view of a bookshelf that uses brackets of the same general kind as shown in FIG. 1.

In any case, the arrangement of an ultimately assembled bookcase may be varied as widely as the imagination of the person making the assembly. FIG. 3 is but one example. In this case, boards 14 and 16 are of different lengths, with assembly 10 near one end being spaced inwardly from the shelf board ends and another assembly 10 being located at an even greater distance from the other end of shelf board 14 and secured to approximately the middle of shelf board 16. Additional shelf boards 70, 72 and 74 are stacked vertically by a staggered array of more assemblies 10 toward both the left and right sides of the bookcase. Illustrating still another variation, the longer legs **18*a* are used with the assembly at the extreme right which supports the third-tier shelf board 70 above bottom shelf board 16**.

In principle, any material of sufficient rigidity may be used in the fabrication of either the legs or the clips. For example, either may be made of wood, plastic or metal. For obtaining substantial strength while yet being light in weight and easily manufactured, it is preferred that clips 40 (including **40*a* and 40*b*) be cut from extrusions of aluminum or an aluminum alloy. A bronze finish has been found to be particularly attractive. On the other hand, it is preferred that legs 18 (and 18*a*) be fabricated from a strong, nicely grained and otherwise attractive wood material. The exterior surface of the wood may be shaped or ornamented in any manner desired to enhance the overall appearance of the resulting bookshelf. In the particular case illustrated in FIG. 1, for example, outer major surface 22 merges in a smooth curve at 76 into end surface 64, the other end portion of leg 18** being formed in the same manner.

When appropriate, the bracket assemblies may be assembled in complete form and then sold with clips already affixed. With that approach, it is desirable to provide assemblies with several different bracket lengths as represented by the difference in lengths between legs 18 and **18*a***. Alternatively, unattached clips may be sold separately, so that the purchaser may buy as many as he needs for his particular bookcase design. At the same time, of course, he would select legs in a length or variety of different lengths again in accordance with his particular design. The kinds of clip versions available also could vary so as also to increase the flexibility of the purchaser's adaptation for a specific design.

In a different approach, it is also contemplated that the materials may be offered separately with the legs being in unfinished form. To that end, a single much-longer strip of already-grooved leg material may be made available to the purchaser along with a selection of clips. In that case, the purchaser may cut the long strips into legs of whatever length or different lengths he desires for his bookcase design. Sanding or other shaping to form curved end surfaces or other ornamentation are left to be done by the purchaser as he desires to proceed on his own or in accordance with suggested guidelines. Of course, the purchaser also is to apply the final surface finish. In this approach, a maximum of ultimate versatility is achieved, because the leg lengths may be varied without limitation and, at the same time, the clips may be installed anywhere desired along the length of the groove formed in any particular leg.

Whichever particular approach and version of clip is chosen, the resulting bookcase is capable of being very attractive. Particularly as a result of using wood for the material of the legs, ornamentation and color of finish may be offered with substantial variation, so as to permit matching to any specific decor. Yet, the manner in which the clips nest tightly within the groove of each leg and seat flat against the bottom of that groove affords the resulting bookcase with a high degree of both ruggedness and stability. At the same time, the individual components are comparatively inexpensive of material procurement and of fabrication. Notwithstanding the pleasing aesthetics or the ruggedness and stability, the bookcase may be easily disassembled when necessary for moving or storage.

While particular embodiments of the invention have been shown and described, and various alternatives and modifications have been specifically mentioned, it will be obvious to those skilled in the art that other changes and modifications may be made without departing from that which is patentable in its broader aspects and, therefore, the aim in the appended claims is to cover all such changes and modifications as fall within the true spirit and scope of the invention.

I claim:

1. A one-piece shelf bracket, for constructing an assembly of shelving from spaced elongated shelf boards of standard thickness, comprising:

a generally U-shaped clip having a pair of plates joined by a flat bight with said plates being parallel-spaced apart a distance substantially equal to said standard thickness for snug engagement with the marginal edge portion of a shelf board;

means defining an aperture through one of said plates and receptive of a fastener for securing said one plate against the marginal edge portion of a shelf board engaged by said one clip to prevent horizontal displacement of said shelf board;

means defining a pair of laterally-spaced apertures extending through said bight and receptive of a fastener for securing said clip into a fixed location;

a first stub integrally projecting outwardly from the exterior of one of said plates and in alignment with said bight;

a second stub integrally projecting outwardly from the exterior of the other of said plates and in alignment with said bight;

and means, defined at each entrance for the respective one of said fasteners into corresponding ones of said apertures, for enabling said fasteners effectively to seat flush and unobtrusively within said openings and thereby enable said bight to seat flush against said marginal edge of said shelf board.

* * * * *